US011333474B2

(12) United States Patent
Ahrens et al.

(10) Patent No.: US 11,333,474 B2
(45) Date of Patent: May 17, 2022

(54) APPARATUS AND METHOD FOR BLASTING

(71) Applicants: Brandon Ahrens, Albuquerque, NM (US); Thomas Heine, Edgewood, NM (US)

(72) Inventors: Brandon Ahrens, Albuquerque, NM (US); Thomas Heine, Edgewood, NM (US)

(73) Assignee: EXPLOSIVE ALTERNATIVES, INC., Albuquerque, NM (US)

( * ) Notice: Subject to any disclaimer, the term of this patent is extended or adjusted under 35 U.S.C. 154(b) by 109 days.

(21) Appl. No.: 15/669,802

(22) Filed: Aug. 4, 2017

(65) Prior Publication Data

US 2018/0038676 A1 Feb. 8, 2018

Related U.S. Application Data

(60) Provisional application No. 62/371,832, filed on Aug. 7, 2016.

(51) Int. Cl.
*F42D 1/045* (2006.01)
*F42D 3/04* (2006.01)
(Continued)

(52) U.S. Cl.
CPC ..... *F42D 1/045* (2013.01); *C06B 47/00* (2013.01); *F42B 3/00* (2013.01); *F42B 3/003* (2013.01);
(Continued)

(58) Field of Classification Search
CPC .... F42B 3/00; F42B 3/003; F42B 3/10; F42B 3/26; F42B 3/087; F42B 12/52;
(Continued)

(56) References Cited

U.S. PATENT DOCUMENTS 1,157,270 A * 10/1915 Weber ..... F42B 3/003 102/315
1,845,687 A * 2/1932 Tese ..... F42B 3/00 102/322
(Continued)

FOREIGN PATENT DOCUMENTS

CN 1648594 A * 8/2005
EP 0968736 A1 * 1/2000 ..... A61M 39/02
WO WO-2018031430 A1 * 2/2018 ..... F42B 12/52

OTHER PUBLICATIONS

Written Opinion of the International Searching Authority in PCT/US2017/045652 (Year: 2017).*
(Continued)

*Primary Examiner* — James S Bergin
(74) *Attorney, Agent, or Firm* — Diane E. Albert

(57) ABSTRACT

The present invention provides an explosive method that improves on methods currently employed. The present invention provides for a safer, less expensive, and more portable explosive device. The elements of the present invention replace dynamite or similar explosives currently used in avalanche control and bore hole blasting of rock or other solids. The present invention comprises an apparatus and a method providing a much safer alternative employing a highly confined combustion reaction of a flammable vapor, whereas dynamite is a category 1.1 high explosive imbued with all the attendant safety and security concerns. The method of the present invention provides for an improved
(Continued)

and safer method of blasting employing a highly confined combustion reaction of a flammable vapor instead of conventional explosives currently used.

11 Claims, 8 Drawing Sheets

(51) Int. Cl.

| | |
|---|---|
| ***F42D 3/00*** | (2006.01) |
| ***F42D 1/18*** | (2006.01) |
| ***F42B 12/52*** | (2006.01) |
| ***F42B 3/00*** | (2006.01) |
| ***C06B 47/00*** | (2006.01) |
| *F42B 3/26* | (2006.01) |
| *F42B 12/20* | (2006.01) |
| *F42B 39/30* | (2006.01) |
| *C06C 5/06* | (2006.01) |
| *F42D 1/10* | (2006.01) |
| *E01F 7/04* | (2006.01) |

(52) U.S. Cl.
CPC ..... *F42B 12/52* (2013.01); *F42D 1/18* (2013.01); *F42D 3/00* (2013.01); *F42D 3/04* (2013.01); *C06C 5/06* (2013.01); *E01F 7/04* (2013.01); *F42B 3/26* (2013.01); *F42B 12/207* (2013.01); *F42B 39/30* (2013.01); *F42D 1/10* (2013.01)

(58) Field of Classification Search
CPC . F42B 12/207; F42D 1/00; F42D 1/04; F42D 1/045; F42D 3/00; F42D 3/04; F42D 3/06; F42D 5/05; E01F 7/00; E01F 7/045; E01F 7/04; C06B 47/00; C06C 5/06
USPC ..... 102/314, 315, 322, 331
See application file for complete search history.

(56) References Cited

U.S. PATENT DOCUMENTS

| | | | | |
|---|---|---|---|---|
| 2,578,726 | A * | 12/1951 | Moore | F42B 12/50 102/369 |
| 3,600,116 | A * | 8/1971 | Clark, Jr. | E02F 3/8883 431/1 |
| 3,658,005 | A * | 4/1972 | Byrne | F42B 12/52 102/363 |
| 6,324,982 | B1 * | 12/2001 | Eybert-Berard | F42D 3/00 102/363 |
| 6,374,717 | B1 * | 4/2002 | Schippers | F42D 3/00 102/301 |
| 7,707,938 | B2 * | 5/2010 | Hisel | F41H 9/04 102/302 |
| 7,947,137 | B2 * | 5/2011 | Zubrin | C06D 5/08 149/1 |
| 8,430,032 | B2 * | 4/2013 | Farizy | F42D 3/00 102/363 |
| 8,904,938 | B2 * | 12/2014 | Sasaki | F42B 3/00 102/202.7 |
| 10,968,579 | B2 * | 4/2021 | Brophy | F42B 3/22 |
| 2006/0107827 | A1 * | 5/2006 | Richards | F42B 33/06 86/50 |
| 2020/0103212 | A1 * | 4/2020 | Ahrens | F42D 3/04 |

OTHER PUBLICATIONS

International Search Report in PCT/US2017/045652 (Year: 2017).*
International Preliminary Reporton Patentability in PCT/US2017/045652 (Year: 2017).*
Supplementary European Search Report in EP 17 84 0075 (Year: 2020).*
European Opinion in EP 17 84 0075 (Year: 2020).*
EPO Interview Summary dated Dec. 10, 2021 in EP 17 840 075 (Year: 2021).*
China Patent Office, Second Office Action dated Nov. 16, 2021 in CN 201780048180 (Year: 2021).*

* cited by examiner

APPARATUS AND METHOD FOR BLASTING

CROSS-REFERENCE TO RELATED APPLICATIONS

This application claims the benefit of U.S. Provisional Application No. 62/371,832 filed Aug. 7, 2016 and the entire content is incorporated by reference herein and made part of this specification.

BACKGROUND OF THE INVENTION

Field of the Invention (Technical Field)

The present invention relates to an apparatus and a method to prevent avalanches by providing an improved explosive that provides a confined flammable vapor prepared at time of use in lieu of the conventional high explosive currently used. The method of the present invention provides for an improved and safer method to prevent avalanches employing a highly confined combustion reaction of a flammable vapor instead of conventional explosives currently used.

Avalanche control or avalanche defense activities reduce the hazard avalanches pose to human life, activity, and property. Avalanche control begins with a risk assessment conducted by surveying for potential avalanche terrain by identifying geographic features such as vegetation patterns, drainages, and seasonal snow distribution that are indicative of avalanches. The hazard is assessed by identifying threatened human geographic features such as roads, ski hills, and buildings from the identified avalanche risks. Avalanche control programs address the avalanche hazard by formulating prevention and mitigation plans which are then executed during the winter season.

Prevention and mitigation plans currently combine extensive snow pack observation with three major groups of interventions, namely active, passive, and social which are sometimes more narrowly defined as "explosive," "structural," and "awareness" according to the most prevalent technique used in each. Avalanche control techniques either directly intervene in the evolution of the snow pack or lessen the effect of an avalanche once it has occurred. Avalanche control organizations develop and train exhaustive response and recovery plans for the event of human involvement.

Active techniques reduce the risk of an avalanche occurring by promoting the stabilization and settlement of the snow pack through three forms of intervention, namely disrupting weak layers in the snow pack, increasing the uniformity of the snow pack, and lessening the amount of snow available in snow pack for entrainment in an avalanche. This can be accomplished either by triggering smaller and thus less hazardous avalanches or by directly influencing the structure of the layering of the snow pack.

Active avalanche control can be broadly classified into control via either mechanical or explosive methods. Mechanical methods are typically used in either remote terrain, smaller terrain, or less hazardous terrain while explosive methods are used in accessible large high hazard terrain or terrain with industrial, commercial recreational, urbanized, and transportation usage.

Explosive techniques involve the artificial triggering of smaller less destructive avalanches by detonating charges either above or on the snow surface. The explosives may be deployed by manually hand tossing and lowering, by bombing from a helicopter, or by shelling with a small howitzer, recoilless rifle, or air gun. Each method has its drawbacks and advantages in balancing the hazard to personnel with the effectiveness of the deployment method at accessing and triggering avalanche terrain.

Among the newest methods, strategically placed remote controlled installations that generate an air blast by detonating a fuel-air explosive above the snow pack in an avalanche starting zone offer fast and effective response to avalanche control decisions while minimizing the risk to avalanche control personnel, a feature especially important for avalanche control in transportation corridors.

Explosive control has proved to be effective in areas with easy access to avalanche starting areas and where minor avalanches can be tolerated. It is mostly unacceptable, however, in areas with human residence and where there is even a small probability of a larger avalanche.

The present invention provides an explosive method that improves on present methods. The present invention provides for a safer, less expensive, and more portable explosive device. The elements of the present invention replace dynamite or similar explosives currently used in avalanche control. The present invention comprises an apparatus and a method providing a much safer alternative employing a highly confined combustion reaction of a flammable vapor, whereas dynamite is a category 1.1 high explosive imbued with all the attendant safety and security concerns.

The apparatus and method of the present invention overcomes the deficiencies of the devices and methods currently used because the apparatus and method are both straightforward and elegant.

BRIEF DESCRIPTION OF THE SEVERAL VIEWS OF THE DRAWINGS

The accompanying drawings in the attachment, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

SUMMARY

Figure 1:
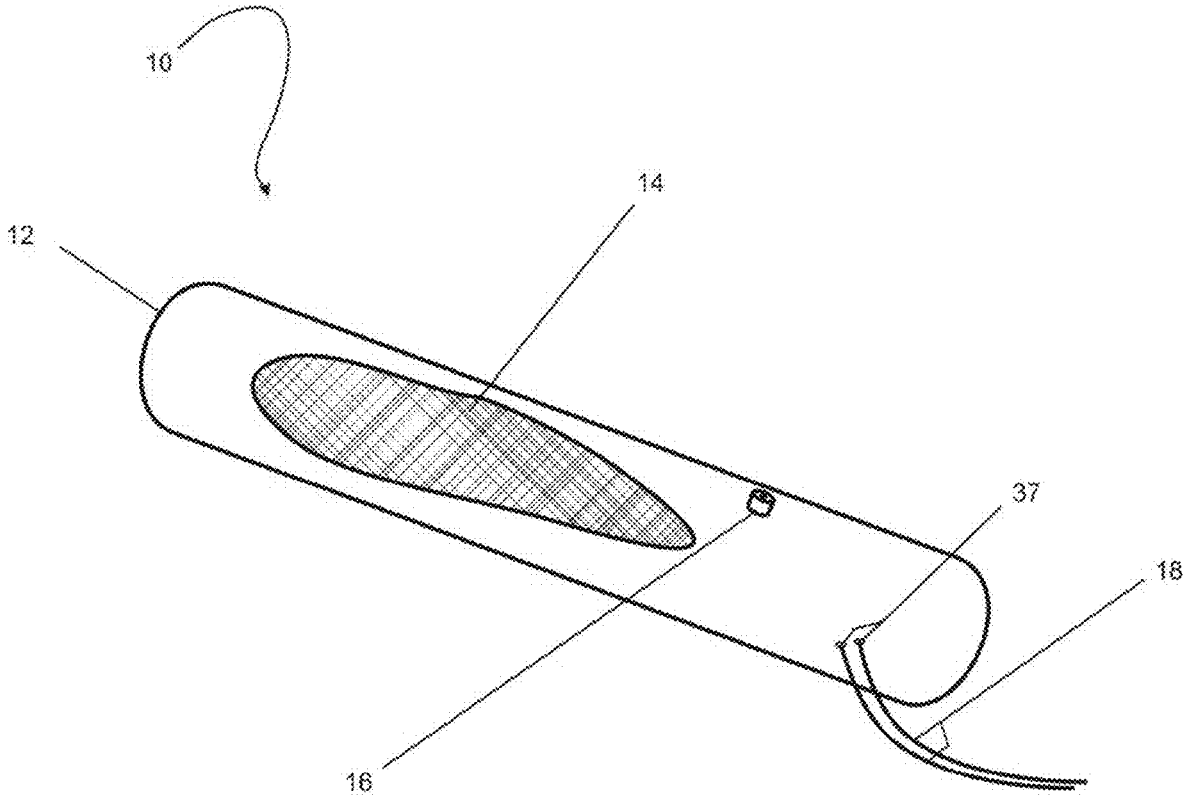
FIG. 1 is an illustration of the apparatus of the present invention which also illustrates how the mixture of fuel vapor and oxygen under pressure is disposed.

We claim a preferred embodiment comprising an avalanche-controlling apparatus comprising a container with an outer casing; a valve disposed in a portal that pierces said container casing for admitting fuel and oxygen; ignitor wires that are disposed within the container; and a resistive element that is connected to the ignitor wires.

The apparatus further comprises an injector that is inserted in the valve. The injector further comprises a plunger and a hollow needle. The apparatus further comprises ignitor wires that are disposed in channels that completely pierce the casing. The ignitor wires are connected to a resistive element, and the resistive element is disposed within the container. The injector is inserted in the valve and is attached to a detonator at one end, and the detonator is disposed exterior to the container.

We claim a preferred embodiment comprising a method for controlling avalanches comprising providing a container with an outer casing; disposing a valve in a portal that pierces the casing; admitting fuel and oxygen through the valve to within the container; disposing ignitor wires within the container, and applying an electrical pulse to the wires; and connecting a resistive element to the ignitor wires.

The method further comprises disposing the ignitor wires in channels through the casing, connecting the ignitor wires to a resistive element disposed within the container, disposing a detonator exterior to the container and connecting the wires to the detonator, inserting an injector into the valve, pushing an injector plunger and injecting fuel through a hollow needle into the container, inserting oxygen into the container to a pressure of 275 to 400 kilopascals, and heating the resistive element and detonating the fuel and oxygen mix.

We claim an alternate embodiment of the present invention comprising a method for blasting comprising inserting a plug into a drill hole; injecting fuel into the drill hole through a channel in the plug via a hollow needle; inserting ignitor wires into the bore hole via channels drilled through the plug; igniting the fuel by heating a resistive element attached to the ignitor wires; and fracturing material surrounding the bore hole.

The method further comprises injecting fuel by completely puncturing the plug with the hollow needle.

The method further comprises removing the hollow needle and collapsing the channel in the plug and sealing the bore hole, creating a highly confined flammable vapor within the bore hole, and creating a highly confined combustion reaction of the fuel.

DETAILED DESCRIPTION OF THE INVENTION

The present invention provides an apparatus to control and dissipate avalanches and a method comprising controlling avalanches. Current avalanche control measures consist primarily of explosive charges that have significant safety concerns. Mitigating these safety concerns is expensive. The present invention comprises an apparatus that produces the same sort of blast wave as conventional explosives without the attendant safety concerns.

The preferred embodiment of the present invention comprises an assembly that produces a heavily confined deflagration of an explosive fuel oxygen mixture. The apparatus comprises an outer casing comprising a container comprising a fiber reinforced flexible plastic tubing that is folded and sealed at the first end and the second end of the container. The explosive mixture disposed within the container comprises pressurized oxygen and hydrocarbon fuel comprising gasoline.

The preferred ignition mode method comprises providing a resistive element comprising a resistor or piece of nichrome wire disposed inside the blaster. Next, a high voltage, low current pulse is applied to the element causing a spark or hot spot to ignite the vapor.

An alternate embodiment of the method of the present invention comprises providing a penetrating ignition system that pierces the container to ignite the contents of the container. The method comprises using pressurized oxygen for either igniter type which provides energy densities approaching that of conventional high explosives.

The apparatus of the present invention exhibits approximately half the energy density (energy per volume) as dynamite but at a considerably reduced weight i.e. less than half the weight. Strong casing materials provide higher loading pressures which provide energy per volume densities to approach those of dynamite, but with even further reduction in weight. The casing material comprises a variety of reinforced polymer as well as paper based cases.

The apparatus of the present invention comprises elements that are easily and safely handled separately until time of combination and thus time of avalanche control. The apparatus of the present invention comprises a container comprising a casing that separates into small, soft pieces that are biodegradable. The apparatus is easily scalable for the production of larger blast waves. The apparatus of the present invention is provided in a plurality of sizes and thus the apparatus provides blasts comparable to several sticks of dynamite and even greater, depending on the size of the apparatus. The preferred embodiment of the apparatus of the present invention comprises a container with dimensions of approximately fifty (50) millimeters in diameter and three hundred (300) millimeters long. However, the size of the apparatus is quite variable. The apparatus is scalable and remains functional. The container diameters range in size from 20 mm to 300 mm and lengths from 200 mm to several meters. When the apparatus is used in a drill hole, the length of the drill hole is whatever the mining or construction industry customarily uses.

The preferred method of use embodiment of the present invention comprises the following steps. The method comprises disposing fuel including but not limited to gasoline or a petroleum distillate in the amount of five (5) to ten (10) milliliters into the container comprising a casing using a syringe comprising a standard football inflation needle. Ten milliliters of gasoline has approximately the same energy as third of a stick of dynamite. Different snow conditions respond better to different sized blasts, so the present invention comprises a selection of different sizes of blaster produced to control avalanches in different conditions.

The container comprising an outer casing is subsequently inflated with oxygen under pressure to 275 to 400 kilopascals depending on fuel load. Approximately one milliliter of fuel is used for every thirty-five (35) kilopascal of oxygen ($O_2$). The casing also contains a few (2 to 4) milliliters of a commercially available tire sealant mixture comprising a thick liquid to help seal any small leaks. The sealant is inserted preferably by pouring in the cavity of the apparatus before the casing is sealed.

The method of use further comprises the following steps. The apparatus of the present invention is shaken for a short period of time, such as a few seconds, with the sealant droplets aiding the evaporation of the fuel. However, the droplets of sealant do not evaporate but create turbulence in the gases disposed within the apparatus when it is shaken much as the bead in a spray paint can which aids evaporation of the fuel and the mixing of the fuel vapor with the oxygen after the fuel and oxygen have been put into the container. The ignitor is lit using commercially available fusing systems or other systems and the confined reaction bursts the casing and produces a blast wave when the mixture is ignited.

An alternate embodiment of the present invention comprises a method for blasting in hard rock for mining or construction or in coal for coal mining. Heavy confinement of a burning vapor reaction leads to a true detonation which will fracture coal or rock.

The method comprises the following steps. First, a hole is drilled into the coal or rock as in traditional blasting. Next, the hole is flushed with oxygen and a plug is inserted into the neck of the hole. Flammable fuel is then injected into the hole. Next, oxygen under pressure is introduced and the mixture is ignited.

The heavy confinement of the burning vapor provided by rock or coal causes the reaction rate to increase to the point where a true detonation occurs. The resulting shock from the detonation fractures the rock or coal.

The plug is comprised of a plurality of materials including but not limited to metal, polymers or a combination thereof. A valve through which fuel and oxygen is disposed within the plug. The valve comprises an electrical feedthrough for igniter wires to be disposed within.

A plurality of plug designs comprises plugs that are common in plumbing and gas tubing industries. "Off the shelf" plugs are modified with the addition of valves and electrical feed-throughs.

FIG. 1 is an illustration of the preferred embodiment of apparatus 10 of the present invention. Casing 12 comprises a case comprised of biodegradable plastic, paper, fiber reinforced flexible plastic, or other suitable materials. Element 14 comprises a cutaway illustrating the interior of the casing which contains flammable vapor. The flammable vapor comprises droplets of liquid sealant, disposed within the container in the liquid fuel comprising gasoline and oxygen under pressure. A liquid fuel coating is disposed within the casing. Valve 16 is disposed in an entrance portal that pierces the outer casing of the container portion of apparatus 10 to enable insertion of fuel and oxygen.

During operation, an igniter comprising ignitor wires 18 is disposed so that an electrical pulse applied to the wires that penetrate the casing via openings 37 heats attached resistive element 53 which ignites the fuel oxygen mixture causing the casing to rupture and produce a blast.

The method of use of the present invention comprises using a wide range of fuel/oxygen ratios that produce a detonation or alternately a useful conflagration. The apparatus of the present invention is not particularly sensitive to fuel type. White gas, aviation gas, automotive gasoline and including but not limited to other hydrocarbons all work. The key enabling factor of the method of the present invention is the oxygen under pressure. Pressurizing the oxygen introduces more fuel than would otherwise be possible because there are more reactants present. Also, using pure oxygen instead of air removes the inert (mostly nitrogen) gases in air that do not contribute to the reaction. The presence of only reactants with no inert gases to delay the reaction under pressure allows the combustion to proceed rapidly. Inert compounds such as nitrogen absorb heat from the reaction as it would occur in air causing the rate of reaction of slow considerably. As the reaction takes place, internal pressure builds, further accelerating the reaction of the remaining reagents.

Figure 2:
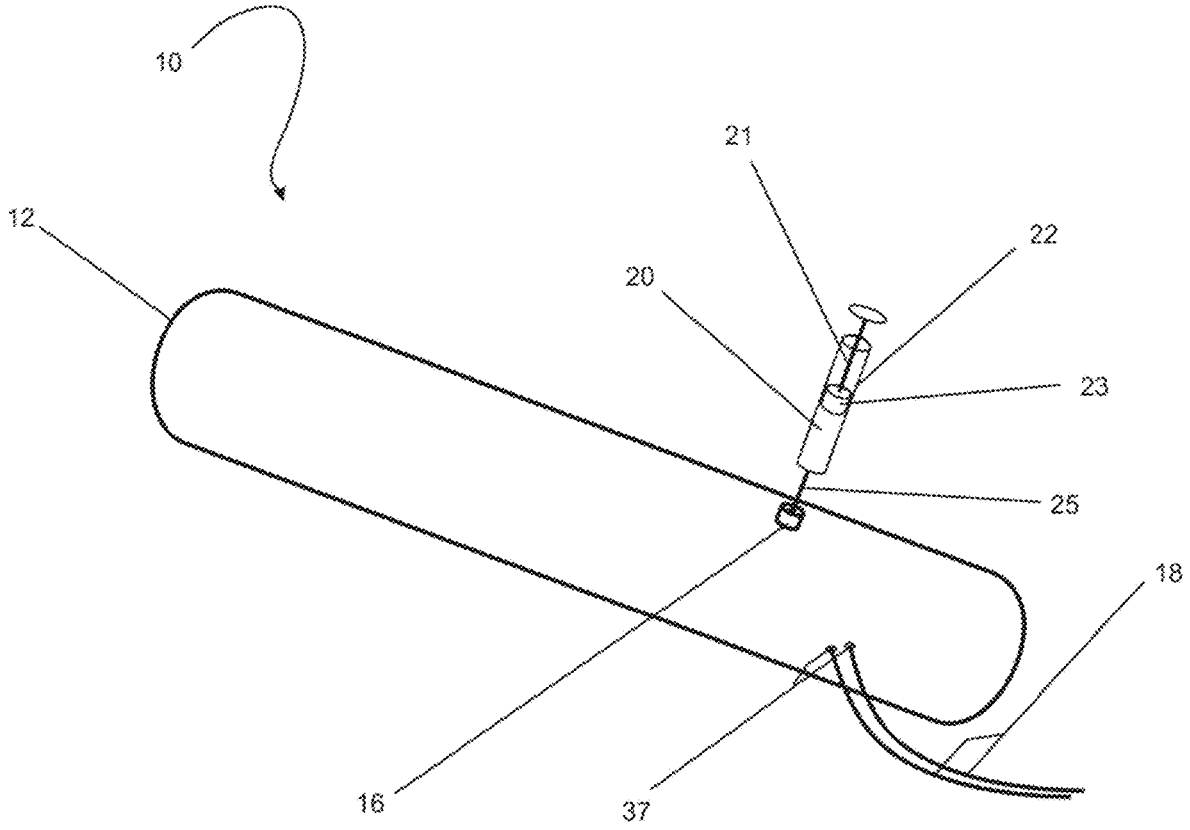
FIG. 2 illustrates how fuel is disposed in the apparatus.

FIG. 2 illustrates how fuel is disposed in apparatus 10. FIG. 2 illustrates casing 12 which is pierced by injector 22. Fuel is inserted into the interior of the blasting apparatus manually via valve 16. The amount of fuel inserted varies depending on the type of apparatus, and is scalable. Plunger 21 as in a hypodermic needle, piston part of plunger 23, and hollow needle 25 comprise fuel 20 delivery system. The method comprises an apparatus configured to puncture the casing at time of operation to avoid a potentially leaky feedthrough.

Figure 3:
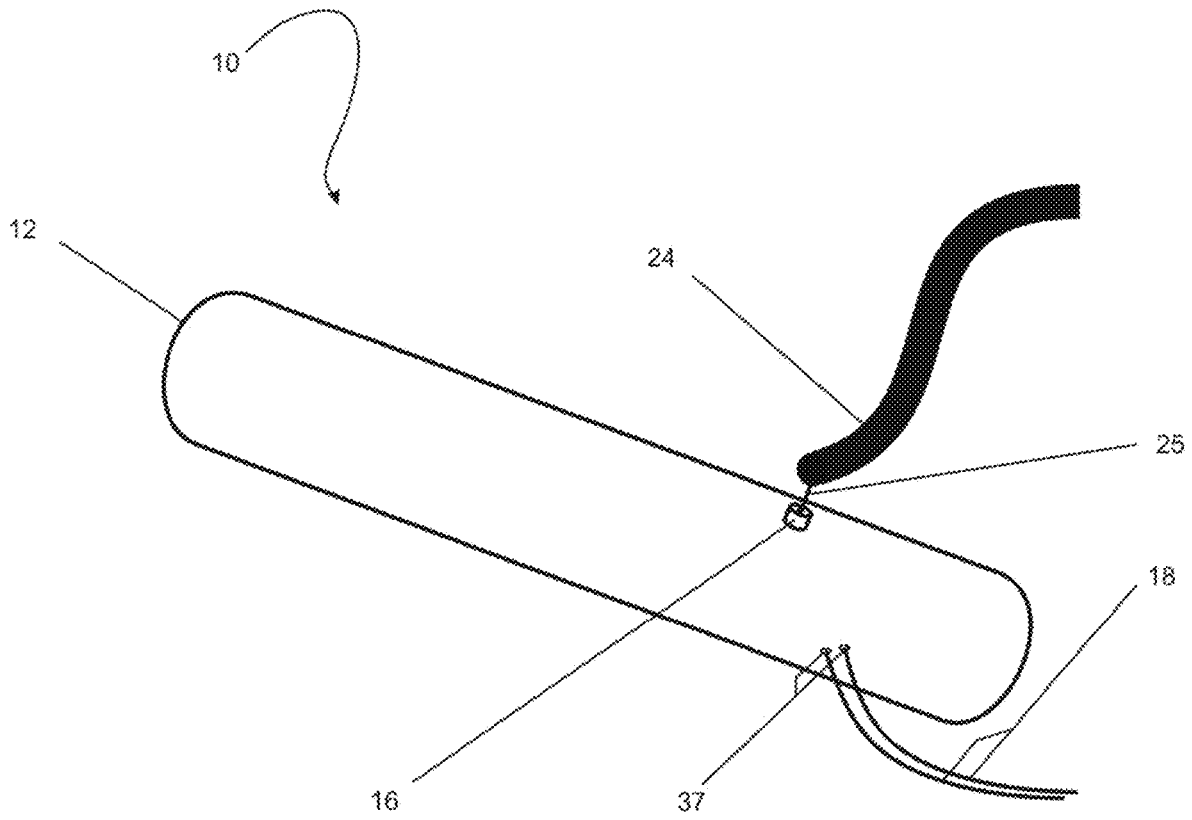
FIG. 3 illustrates how oxygen is disposed in the apparatus.

FIG. 3 illustrates how oxygen is disposed within apparatus 10. FIG. 3 illustrates how the mixture of fuel vapor and oxygen under pressure is disposed. Hose 24 is connected to a source of pressurized oxygen. Hose 24 deploys oxygen to apparatus 10 via valve 16 and needle 25. Once the fuel and oxygen are inserted as shown in the above figures, the assembly is shaken by hand for a few seconds and the fuel mixes and vaporizes. Some liquid fuel remains adhering to the inner casing wall. For the oxygen a simple regulator is used with standard oxygen bottles such as those used by high altitude mountain climbers to insert the oxygen into the blasters.

The present invention is inert until fuel and oxygen are disposed in it. One embodiment of the present invention, prior to having fuel and oxygen inserted, comprises fiber reinforced plastic hose with a few ml of tire sealant disposed in it. The present invention comprises a rubber inflation valve. While the hose will burn if ignited (PVC plastic) it is not particularly flammable.

Figure 4:
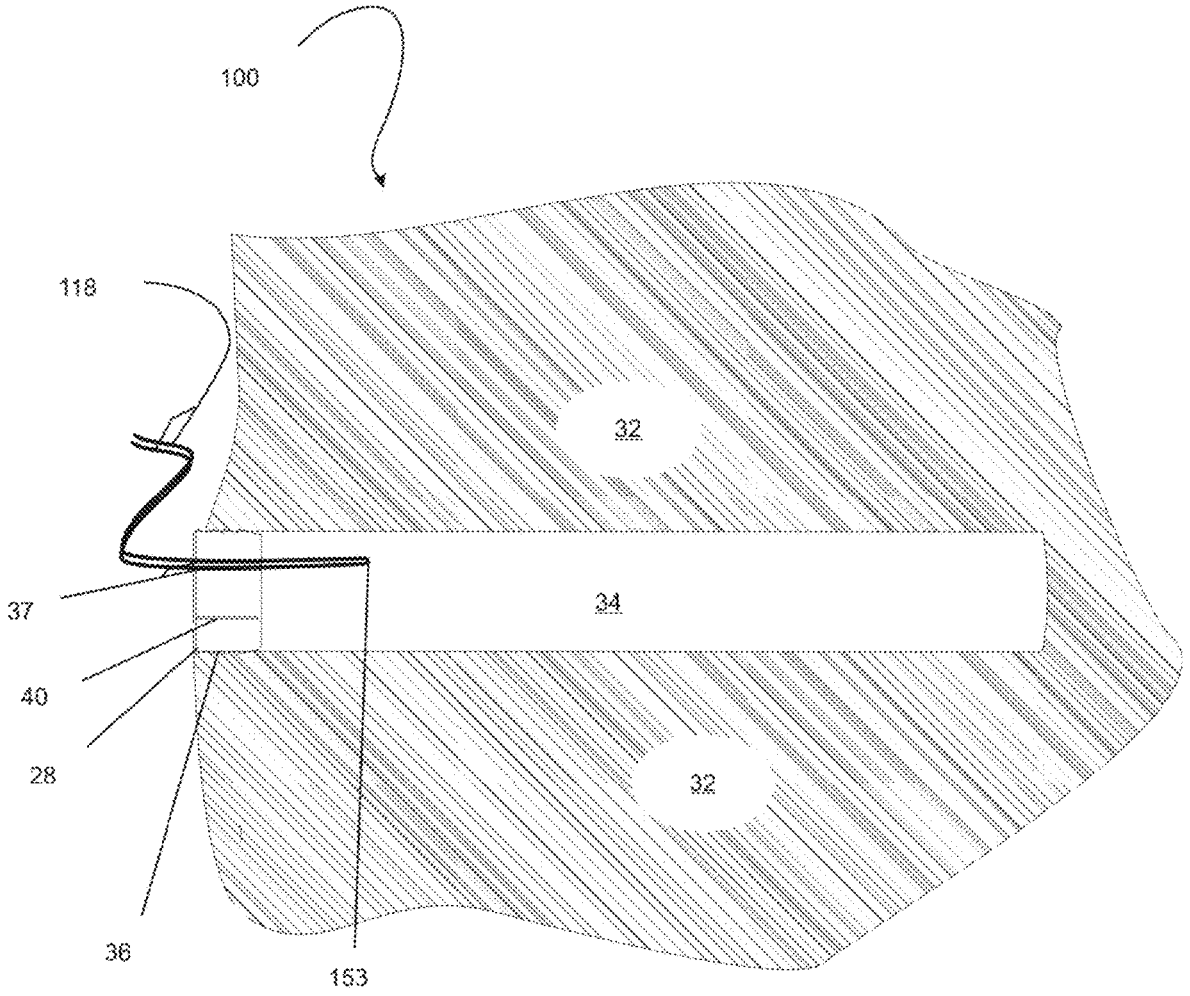
FIG. 4 illustrates an igniter disposed in a drill hole.

FIG. 4 illustrates an alternate embodiment of apparatus 10. FIG. 4 illustrates apparatus 100 and a method to blast rock or coal or other solid materials 32. Bore hole 34 is used to blast rock, coal, or other materials. Ignitor wires 118 are disposed through channels 37 to the interior of bore hole 34. Channel 40 is disposed in plug 28. Serrated edges 36 disposed on plug 28 ensure a tight fit in bore hole 34 and thus improved performance. The igniter relies only on the energy from the portion of electrical wires 118 that is disposed within and through plug 28 comprising a gas-tight plug that protrudes into drill hole 34 that is filled with a fuel/oxygen mixture.

The two wires 118 are connected to resistive element 153 that is disposed in bore hole 34. When resistive element 153 is heated, an explosion occurs which fractures surrounding material 32.

Another embodiment of the method of the present invention provides less confinement for avalanche control. The method does not create a detonation. A rapid burn and overpressure is produced.

Figure 5:
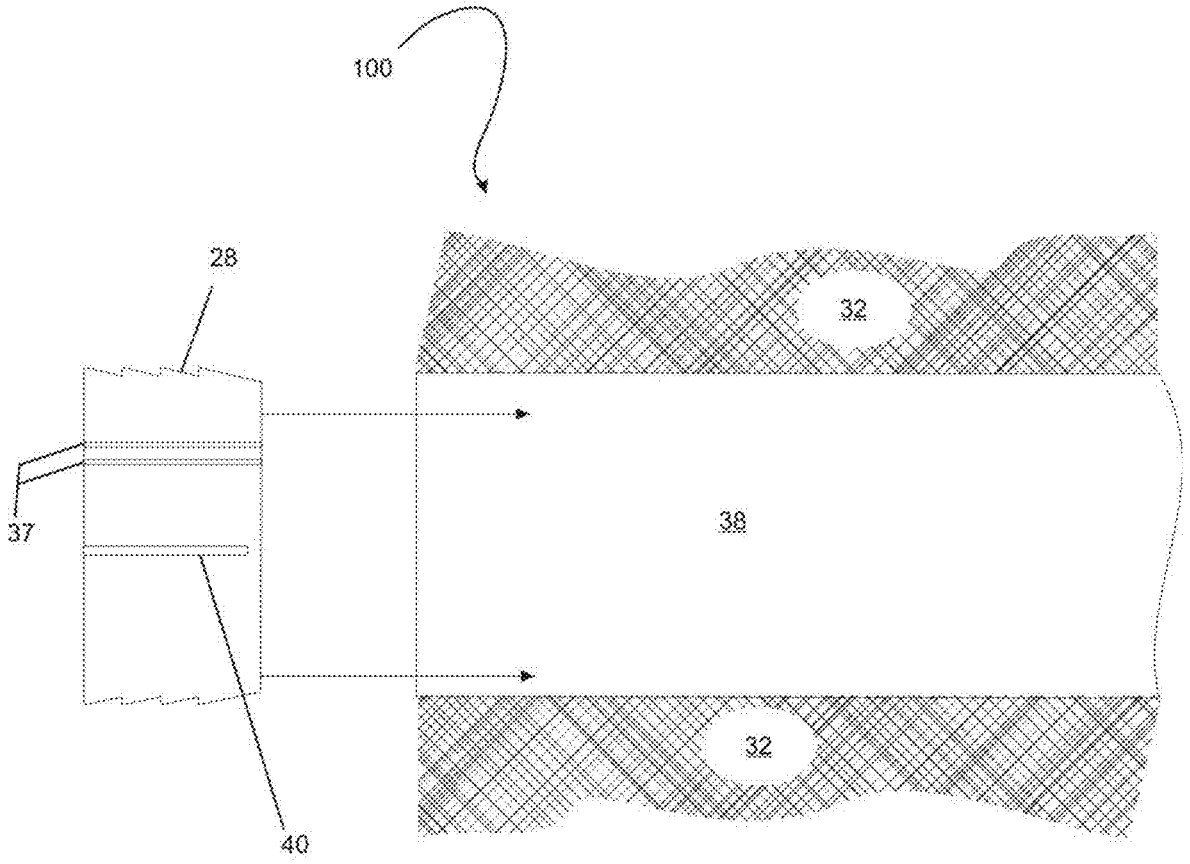
FIG. 5 illustrates a plug with feed-through holes being inserted into a drill hole.

FIG. 5 illustrates alternate embodiment 100 of the present invention. FIG. 5 illustrates plug 28 comprising barbed contour 36 for sealing purposes. Plug 28 comprises a firm elastomere material. Feedthrough channels 37 disposed within plug 28 provide channels for ignitor wires 118. Valve 40 comprises a channel that does not fully penetrate plug 28.

The method of use of the present invention comprises penetrating through the remaining material that 40 has not yet pierced with a needle comprising a hypodermic needle. The plug material 28 then falls back in place when the needle is removed thereby providing the valve seal.

The method comprises the following steps. The method of use illustrated in FIG. 5 illustrates plug 28 which is inserted into drill hole 38 which is drilled in material 32. Fuel is injected into channel 40 by a method comprising delivery via a needle. The hollow needle punctures plug 28 and inserts fuel into the bore hole. Ignitor wires are inserted via channels 37. The fuel is ignited and with the heavy confinement provided by the rock or coal, the reaction transitions from a rapid burn to a true detonation and the solid material fractures.

Figure 6:
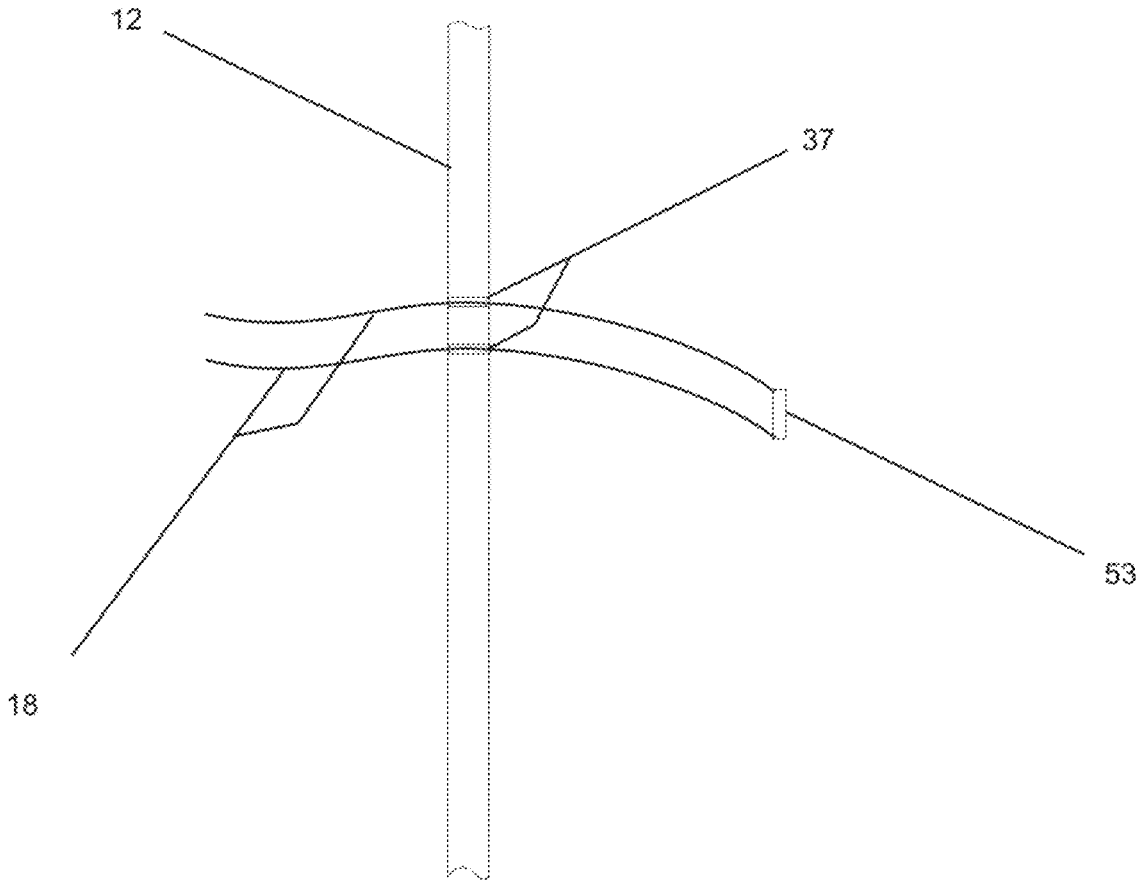
FIG. 6 illustrates a detailed view of an electrical igniter.

FIG. 6 illustrates an exploded view of the preferred embodiment of apparatus 10 of the present invention. Electrical igniter wires 18 are inserted through channels 37 to interior of blaster apparatus 10. Resistive element 53 is connected to wires 18. Heat is generated by resistive element 53 and detonation occurs within the container walls 12 by heated resistive element 53.

Figure 7:
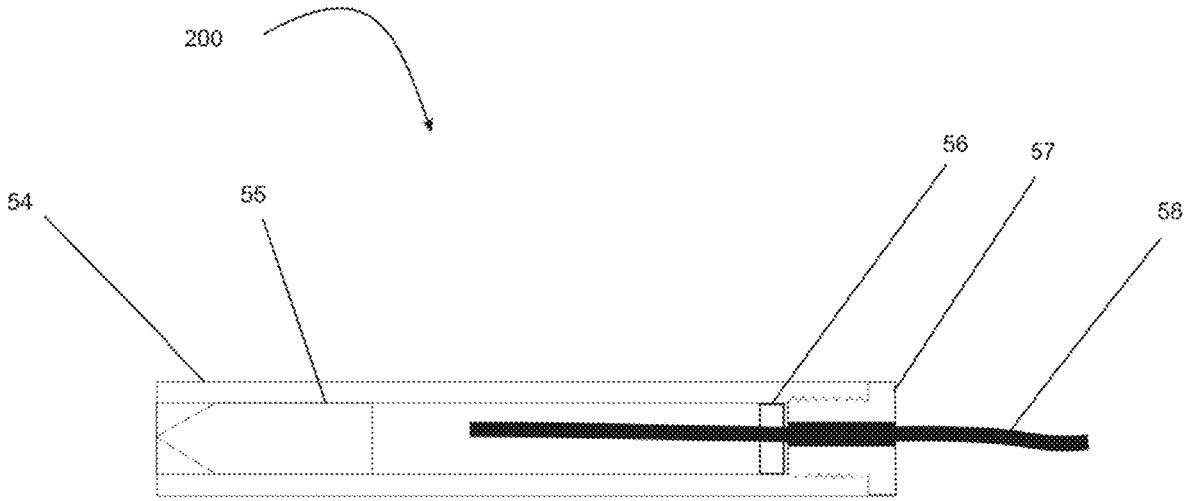
FIG. 7 illustrates an alternative penetrating igniter.

FIG. 7 illustrates yet another embodiment 200 of the present invention. A pyrotechnic igniter is configured to puncture the casing at time of operation to avoid a potentially leaky feedthrough. The igniter relies only on the energy from the portion of fuse 58 that protrudes into casing 54.

The method of use comprises the following steps. When the fuse burns past end plug 57 and gasket 5 comprising silicone, soft rubber, or an alternate material. the gasket collapses sealing the interior of the barrel. The burning fuse produces gasses that raise the pressure inside the barrel and penetrator 55 moves rapidly down the barrel. The barrel is placed in contact with the casing and the piercer punctures the casing. The hot gasses present inside the barrel force their way into the casing igniting the explosive mixture.

Example 1

Figure 8:
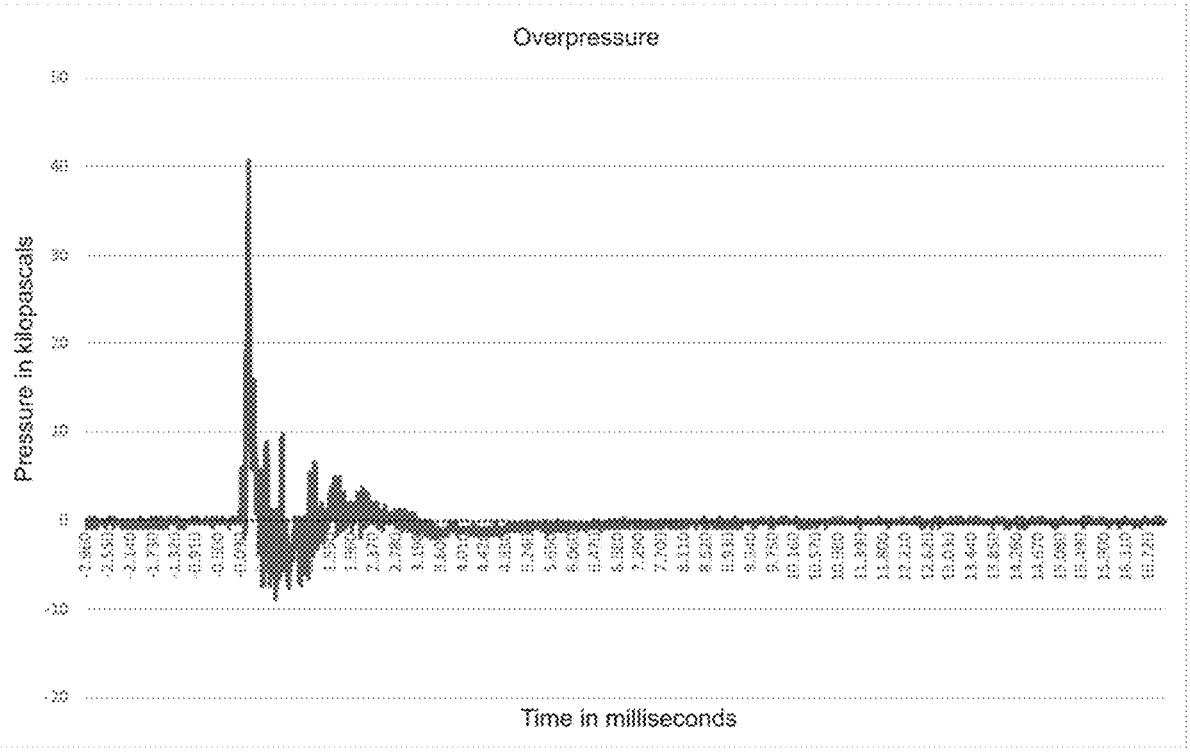
FIG. 8 illustrates a pressure graph.

FIG. 8 illustrates results of a test of the present invention. The pressure was measured in kilopascals and the time was measured in milliseconds.

A blaster pressure graph with a blast sensor was disposed approximately one meter from the apparatus.

The apparatus was placed on the ground.

The chart in FIG. 8 documents a blast pressure profile from a typical apparatus configuration with 20 ml of fuel and oxygen at 210 kPa.

The volume of the apparatus was approximately 0.49 liters.

the measured peak pressure was approximately 37 kPa.

Although the invention has been described in detail with particular reference to these preferred embodiments, other embodiments can achieve the same results. Variations and modifications of the present invention are obvious to those skilled in the art and it is intended to cover all such modifications and equivalents.

What is claimed is:

1. An avalanche-controlling apparatus comprising:

a container comprising an outer casing;

a valve disposed in a portal that completely pierces said outer casing for admitting fuel in the form of a liquid hydrocarbon and pressurized oxygen to form within the container an explosive mixture comprising said liquid hydrocarbon fuel and pressurized oxygen;

ignitor wires that are disposed within said container; and a resistive element disposed within said container that is connected to said ignitor wires; and the avalanche-controlling apparatus further comprising an injector for insertion in said valve, said injector comprising a plunger and a hollow needle.

2. The avalanche-controlling apparatus of claim 1 wherein said ignitor wires are disposed in channels that completely pierce said casing.

3. The avalanche-controlling apparatus of claim 1 further comprising a detonator attached to said ignitor wires, said detonator disposed exterior to said container.

4. The avalanche-controlling apparatus of claim 1 wherein said outer casing comprises biodegradable plastic, fiber-reinforced flexible plastic, or paper.

5. A method for controlling avalanches comprising:

providing a container with an outer casing;

disposing a valve in a portal that pierces the casing;

admitting fuel in the form of a liquid hydrocarbon and pressurized oxygen through the valve to within the container to form within the container an explosive mixture comprising said liquid hydrocarbon fuel and pressurized oxygen;

disposing ignitor wires and a resistive element within the container;

connecting the resistive element to the ignitor wires; and applying an electrical pulse to the ignitor wires.

6. The method of claim 5 further comprising disposing the ignitor wires in channels through the casing.

7. The method of claim 5 further comprising disposing a detonator exterior to the container and connecting the ignitor wires to the detonator.

8. The method of claim 5 wherein the step of admitting fuel and oxygen to the container includes inserting an injector into the valve.

9. The method of claim 8 wherein the step of admitting fuel and oxygen to the container further includes pushing an injector plunger and injecting fuel through a hollow needle into the container.

10. The method of claim 5 wherein the step of admitting fuel and oxygen to the container includes inserting oxygen into the container to a pressure of 275 to 400 kilopascals.

11. The method of claim 5 wherein the outer casing comprises biodegradable plastic, fiber-reinforced flexible plastic, or paper.

* * * * *